United States Patent [19]

Ohe et al.

[11] 4,412,789

[45] Nov. 1, 1983

[54] OIL PUMP UNIT

[75] Inventors: Takeshi Ohe; Hiroshi Ohsaki, both of Higashimatsuyama, Japan

[73] Assignee: Jidosha Kiki Co., Ltd., Tokyo, Japan

[21] Appl. No.: 308,762

[22] Filed: Oct. 5, 1981

[30] Foreign Application Priority Data

Oct. 31, 1980 [JP] Japan ..... 55-154470
Jan. 24, 1981 [JP] Japan ..... 56-9457

[51] Int. Cl.[3] ..... F04B 49/08
[52] U.S. Cl. ..... 417/288; 417/299
[58] Field of Search ..... 417/286, 287, 288, 299, 417/302, 303, 304, 308

[56] References Cited

U.S. PATENT DOCUMENTS 3,985,472 10/1976 Virtue et al. ..... 417/287

FOREIGN PATENT DOCUMENTS 1040904 10/1958 Fed. Rep. of Germany ..... 417/287
665808 1/1952 United Kingdom ..... 417/286

*Primary Examiner*—Richard E. Gluck
*Attorney, Agent, or Firm*—Flynn, Thiel, Boutell & Tanis

[57] ABSTRACT

To supply hydraulic fluid to a hydraulic apparatus, a plurality of pumps are used. One of the pumps is used as a main pump while the remaining pump or pumps are used as sub-pumps. A flow path switching mechanism selectively disconnects the sub-pumps from a supply passage to the hydraulic apparatus. In this manner, a required minimum supply of hydraulic fluid is assured with a simple arrangement while eliminating wasteful energy loss and reducing the dissipation of the horsepower. A reliable operation is maintained without any adverse influence upon the hydraulic apparatus. In one embodiment, a pair of pumps, and a control including a pair of switching valves operating as a pressure sensor and a flow controller are assembled into a pump body. The switching valves assure a reasonable supply of hydraulic fluid to the hydraulic apparatus while minimizing the dissipation of the horsepower. At this end, a pump receiving space is defined within the pump body, and a pair of valve openings are formed around the space and close to each other so that their axes extend parallel to each other. Openings and passages are cast into the pump body or formed by a simple boring operation to provide a communication between these elements. In this manner, the overall arrangement is simple and the manufacturing and assembly are facilitated, reducing the manufacturing cost. A reduction in the size and the weight of the overall unit is achieved.

10 Claims, 17 Drawing Figures

OIL PUMP UNIT

BACKGROUND OF THE INVENTION

The invention relates to an oil pump unit including a plurality of pumps and a hydraulic fluid supply arrangement for selectively supplying hydraulic fluid discharged from these pumps to a hydraulic apparatus.

Considering a power steering system, for example, which is mounted on an automobile to reduce the magnitude of the force which is required for a driver to operate a steering wheel, an oil pump may be used as a source of oil pressure. Such oil pump is driven for rotation by the engine of the automobile, and has a discharge which increases or decreases in proportion to the number of revolutions of the engine. Accordingly, it is necessary that such pump has a sufficient capacity to supply enough fluid to operate the hydraulic apparatus such as the power steering device properly even if the engine operates at a low number of revolutions or with a reduced discharge from the pump.

However, it will be seen that if the pump is provided with such capacity, it follows that an unnecessarily large amount of fluid is supplied when the engine operates at a higher number of revolutions. This not only results in a waste in itself, but also increases the dissipation of the horsepower of the engine which is used to drive the pump to cause a great influence upon the fuel cost of the automobile engine, which is undesirable for the purpose of power saving.

To cope with this problem, there has been provided an arrangement in the prior art which includes a combination of a pair of pumps, each of a reduced capacity, and a control having a flow path switching function so that whenever the discharge from the respective pumps is small, their flow is combined while the hydraulic oil from one of the pumps only is supplied to the power steering device if the discharge from each of these pumps increases, with the other pump being connected to a tank to return the hydraulic oil therefrom. In this manner, the horsepower required to drive the other pump is minimized in order to reduce the dissipation of the horsepower.

The described arrangement is constructed such that a switching of the flow path takes place in accordance with the discharge from each pump or the number of revolutions of the engine. Accordingly, while the dissipation of the horsepower can be reduced when the automobile is running at a high speed or the engine is operating at a higher number of revolutions, a power loss is unavoidable at a lower number of revolutions of the engine, leaving much to be improved.

It is to be noted that the supply of hydraulic oil to the power steering device presents a problem when a high outout is demanded therefrom in response to a high load, or during a steering operation. At other times, for example, when the vehicle is at rest or running straightforward, the supply of hydraulic flow may be maintained low if the engine is operating at a low number of revolutions. In particular, mode running patterns, for example, are frequently utilized with automobiles which run through the city, and hence it is desirable that the dissipation of the horsepower be reduced when the vehicle is running at such low speeds.

This objective can be achieved by employing a control including a flow path switching mechanism which operates by sensing an increased load upon the power steering system. However, a problem arises with such arrangement in that a switching of the flow path takes place to cause an increased dissipation of the horsepower if the engine is operating at a high speed and hence the discharge from a single pump is sufficient to meet the need.

Alternatively, an arrangement is also proposed in which the running speed of an automobile is detected electrically, and a detection signal is utilized to effect a switching of the flow path. However, the vehicle speed is not always proportional to the number of revolutions of the engine or the discharge from the pump, and accordingly, this arrangement cannot assure an effective reduction in the dissipation of the horsepower. In particular, such problem occurs with an overloaded truck which may be running at a low speed while the engine is operating at a higher speed. In addition, the use of electrical detection means and associated solenoid valves involve problems relating to the construction.

SUMMARY OF THE INVENTION

It is an object of the invention to provide an oil pump unit capable of maintaining a positive operation of a hydraulic apparatus while reducing the dissipation of the horsepower by supplying a required minimum amount of hydraulic fluid. This object is achieved by utilizing an arrangement for effecting a switching of the flow path by a combination of a pressure sensitive switching valve which operates in accordance with the magnitude of a load on the hydraulic apparatus and a switching valve of a flow control type which operates in accordance with the discharge from individual pumps.

It is another object of the invention to provide an oil pump unit of the kind described which is simplified in arrangement and has a reduced size and weight. This object is achieved by controlling the supply of hydraulic fluid by a pair of spool valves, each of which functions as a pressure sensitive switching valve responsive to the magnitude of a load on a hydraulic apparatus and a switching valve of a flow control type responsive to the discharge from individual pumps, respectively, so that a coordinated switching of the flow path can be made between the individual pumps and the hydraulic apparatus.

Other objects and advantages of the invention will become apparent from the following description with reference to the attached drawings.

DESCRIPTION OF EMBODIMENTS

Figure 1:
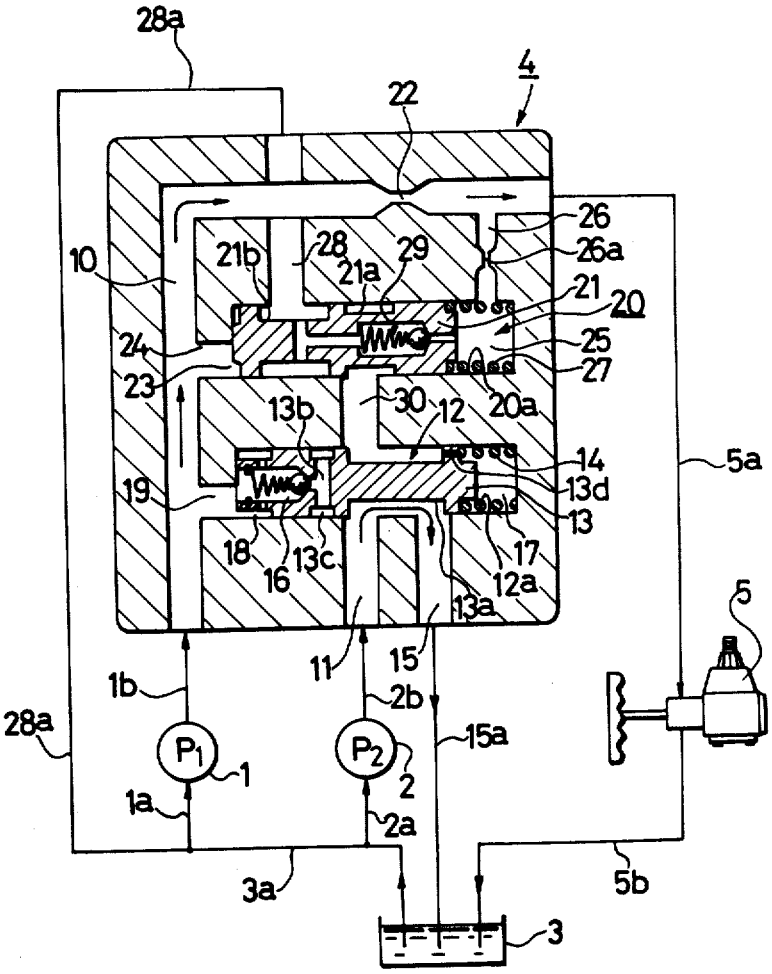
FIG. 1 is a cross section and a schematic view of an oil pump unit according to one embodiment of the invention as applied to a power steering system.

Referring to FIG. 1, there is shown an oil pump unit according to one embodiment of the invention as applied to a power steering system of an automobile. Specifically, there are provided a first and a second pump 1, 2 which separately discharge hydraulic oil, and which are driven for rotation by an engine, not shown. These pumps operate to supply an operating oil from a tank 3 for circulation through a control 4 to be supplied to a power steering system 5. It is to be noted that a power saving effect can be improved by choosing a capacity of the first pump 1 which is less than the capacity of the second pump 2. It will be seen that the pumps 1, 2 include suction lines 1*a*, 2*a* which are connected to a line 3*a* which is in turn connected to the tank 3, and also include discharge lines 1*b*, 2*b*. A hydraulic oil supply line 5*a* interconnects the flow path switching mechanism 4 and the power steering system 5 while a return line 5*b* extends between the system 5 and the tank 3.

The control 4 which selectively supplies the hydraulic oil discharged from the first and the second pump 1, 2 to the power steering system 5 comprises a main passage 10 which is utilized to supply the hydraulic oil from the first pump 1 to the steering system 5, and another passage 11 into which the hydraulic oil from the second pump 2 is introduced. A first switching valve 12 is interposed between these passages 10, 11 and is responsive to a change in the pressure of the hydraulic oil within the main passage 10 which occurs in accordance of the magnitude of a load on the power steering system 5.

The first switching valve 12 includes a spool valve 13 which is slidably disposed within a valve opening 12*a* having its one end opening into the main passage 10. The spool valve 13 is normally urged by a spring 14 to be located toward the main passage 10 or to the left, as viewed in FIG. 1, so that the passage 11 which opens into the axially central region of the valve opening 12*a* is isolated from the main passage 10. Under this condition, the passage 11 is connected through an annular groove 13*a* which is circumferentially formed around the central portion of the spool valve 13, to a drain passage 15 which is formed to extend parallel to the passage 11 and thence communicates through a drain line 15*a* with the tank 3.

Figure 2A:
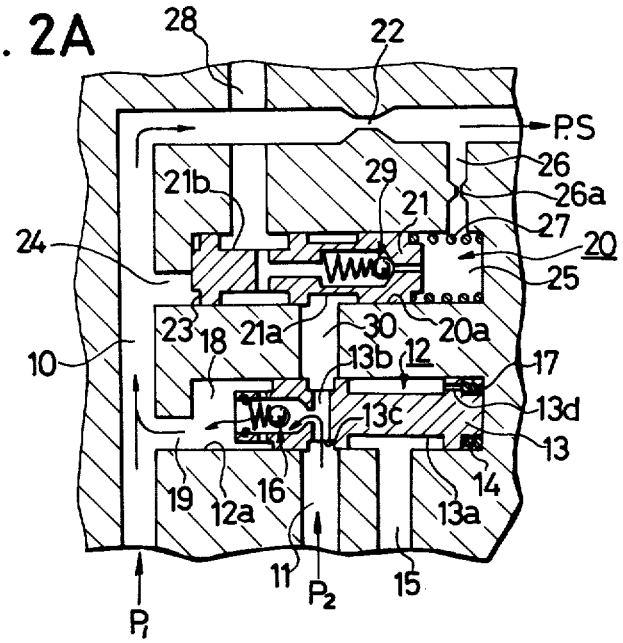
FIGS. 2(A), (B) and (C) are similar views to FIG. 1, illustrating the operative conditions thereof.

The first switching valve 12 is formed with a check valve 16 toward its end of the spool valve 13 located adjacent to the main passage 10. When the spool valve 13 moves to the right, as viewed in FIG. 1, the check valve 16 is connected to the passage 11 through a radially extending opening 13*b* and an annular groove 13*c* which is located around the opening 13*b* in alignment therewith. Obviously, when the first switching valve 12 is so operated, the spool valve 13 interrupts the communication between the passages 11 and 15. Referring to FIG. 2(A), it will be seen that under this condition, the hydraulic oil from the second pump 2 opens the check valve 16 to be introduced into the main passage 10 so as to be merged with the hydraulic oil from the first pump 1 as long as a second switching valve, to be described later, remains inoperative.

The first switching valve 12 includes a low pressure chamber 17 in which the spring 14 is disposed and into which the tank pressure is introduced through a small opening 13*d*. The valve also includes a high pressure chamber 18 which is located on the opposite side from the low pressure chamber and into which the pressure from the main passage 10 is introduced through a path 19. In this manner, as the hydraulic pressure within the main passage 10 rises in response to an increase in the load upon the power steering system 5, the spool valve 13 senses such change by moving to the right, as viewed in FIG. 1.

At a location downstream of the main passage 10, a flow controlling, second switching valve 20 is disposed so as to extend in parallel relationship with the first switching valve 12. The second switching valve 20 senses when a flow through the main passage 10 reaches or exceeds a given value. The second switching valve 20 is constructed in substantially the same manner as a flow control valve provided in the prior art which is operative to return part of the discharge flow from the first pump 1 either alone or in combination with the discharge flow from the second pump 2 whenever the combined flow exceeds a given value, to the tank 3, thereby maintaining the supply of hydraulic fluid to the power steering system 5 below a given level.

Specifically, the second switching valve 20 comprises a spool valve 21 slidably disposed in a valve opening 20*a* having its one end opening into the main passage 10, and an orifice 22 disposed intermediate the main passage 10 to detect the flow therethrough as a pressure differential thereacross. The spool valve 21 defines a high pressure chamber 23 which is connected to the upstream side of the orifice 22 through a path 24, and also defines a low pressure chamber 25 which is connected to the downstream side of the orifice 22 through a path 26 including an orifice 26*a*, which is effective to prevent an oscillation of the spool valve 21. The spool valve 21 is normally urged by a spring 27, disposed within the low pressure chamber 25, to assume a position which is biased toward the high pressure chamber 23 or to the left, as viewed in FIG. 1, where it interrupts a communication between the main passage 10 and a drain passage 28 leading to the tank 3 through a line 28*a*, through the high pressure chamber 23 and the path 24. A relief valve 29 is associated with the spool valve 21. The spring 27 disposed within the second switching valve 20 has a resilience of a magnitude less than that of the spring 14 used in the first switching valve 12.

It is to be noted that there is provided a bypass passage 30 to provide a communication between the first and the second switching valve 12, 20 and the hydraulic oil from the second pump 2 is introduced into the bypass passage 30 through the passage 11. Normally when the second switching valve is not operated, the bypass passage 30 opens into an annular groove 21*a* formed around the spool valve 21 adjacent to the low pressure chamber 25, and is disconnected from the drain passage 28. Consequently, under this condition, the hydraulic oil from the second pump 2 is returned to the tank 3 or introduced into the main passage 10 through the check valve 16 in accordance with the position assumed by the first switching valve 12.

Figure 2B:
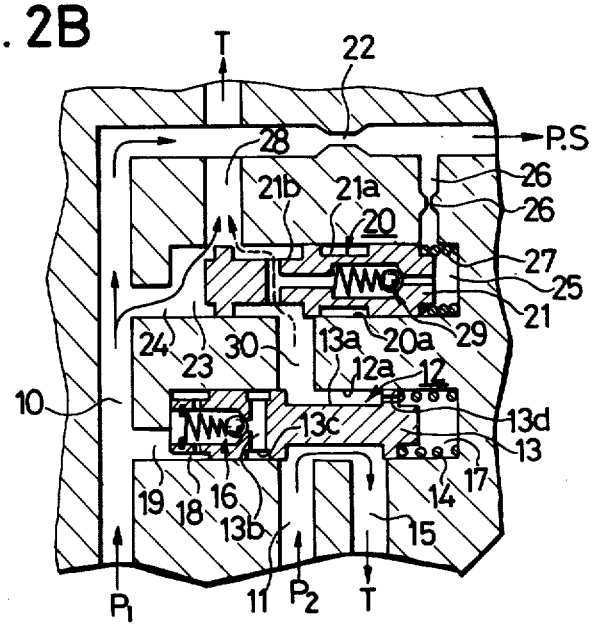
Figure 2C:
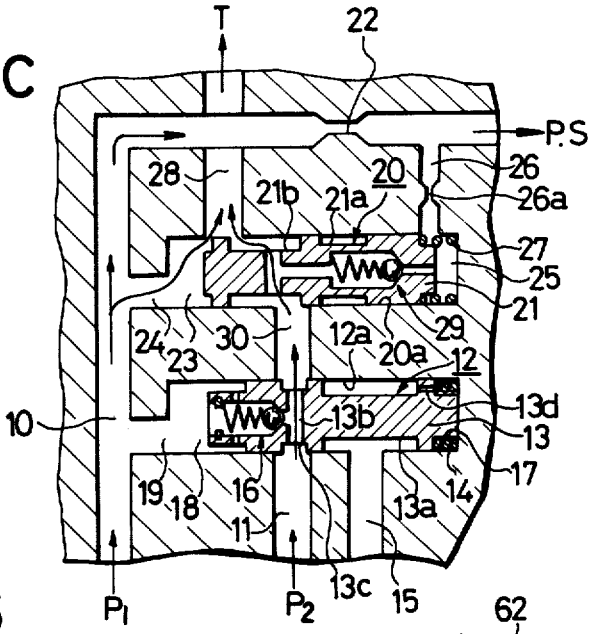

On the other hand, when the second switching valve 20 is operated, it will be seen from FIG. 2(B) that part of the hydraulic oil passing through the main passage 10 is returned to the tank 3, and the bypass passage 30 opens into an annular groove 21*b* formed around the spool valve 21 toward the high pressure chamber 23 and communicates with the drain passage 28 therethrough. If the first switching valve 12 is not operated at this time, the passage 11 communicates with the tank 3 through the drain passages 15, 28, so that the hydraulic oil from the second pump 2 will obviously be returned to the tank 3, presenting no problem whatsoever. However, if the first switching valve 12 is operated, the passage 11 connects to the bypass passage 30 through the annular groove 13*c* and the opening 13*b* leading to the main passage 10 and in which the check valve 16 is disposed, and thence connects to the tank 3 through the annular groove 21*b* and the drain passage 28. Consequently, under this condition, the check valve 16 is not opened by the pressure differential thereacross, with the result that the hydraulic oil from the second pump 2 which is introduced into the passage 11 is fed through the first and the second switching valve 12, 20 and through the drain passage 28 to be returned to the tank 3. This condition is illustrated in FIG. 2(C).

The operation of the control 4 will be more closely considered in relation to the discharge from the respective pumps 1, 2 or the number of revolutions of the engine and to the operation of the power steering system 5.

Initially considering FIG. 1, this Figure illustrates the condition prevalent when the engine operates at a low number of revolutions and the power steering system 5 remains inoperative, or when no load is applied to the power steering system 5, whereby the hydraulic pressure within the main passage 10 is low. Under this condition, both the first and the second switching valve 12, 20 are maintained inoperative, with consequence that the hydraulic oil from the first pump 1 is fed through the main passage 10 to be supplied the power steering system 5 while the second pump 2 is connected to, the tank 3 through the passage 11 and the drain path 15. In this manner, the hydraulic oil circulates between the second pump 2 and the tank 3, maintaining a no-load condition. This is because a reduced supply of hydraulic fluid has no influence whatsoever upon the power steering system 5. The flow response under such condition is indicated by a solid line a in FIG. 3, and the dissipation of the horsepower is indicated by broken lines a in FIG. 4, and may be less than approximately one-half the prior art value, which is indicated by phantom lines b in FIG. 4.

Figure 3:
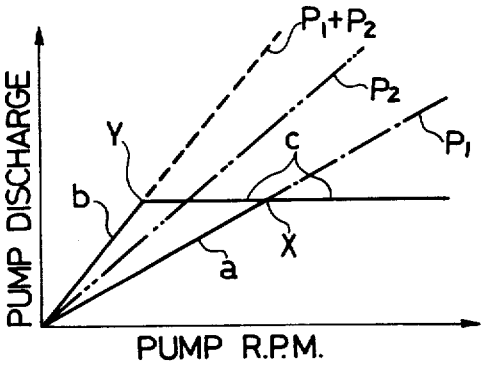
FIG. 3 graphically shows a discharge flow response.
Figure 4:
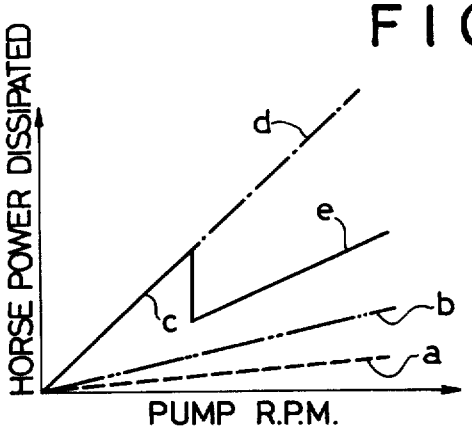
FIGS. 4 and 5 graphically show the relationship of the horsepower dissipated as functions of the number of revolutions and the discharge pressure of the pump.

In FIG. 3, a curve $P_1$ represents the discharge flow from the first pump and $P_2$ the discharge flow from the second pump, while $P_1+P_2$ represents a rectilinear curve indicating the relationship between the combined discharge flow and the number of revolutions.

When the power steering system 5 is operated to increase a load from a low speed and low pressure condition illustrated in FIG. 1 to a low speed and high pressure condition, the first switching valve 12 is operated as indicated in FIG. 2(A) to disconnect the second pump 2 from the tank 3 to connect the second pump to the main passage 10 through the check valve 16. Accordingly, the hydraulic oil from the second pump 2 merges with the hydraulic oil from the first pump 1 within the main passage 10 to be supplied to the power steering system 5, making up an added power for a required steering operation, thus presenting no problem in operation. The flow response with an increase load is indicated by a solid line b in FIG. 3 while the dissipation of the horsepower is indicated by a solid line c in FIG. 4, which remains the same as the prior art value shown by phantom lines d in FIG. 4. It will be evident that no reduction can be achieved in the dissipation of the horsepower under such condition.

Under a high speed and low pressure condition where the discharge flow from the pump increases above a given value as the number of revolutions increases while the power steering system 5 remains inoperative, the second switching valve 20 is operated as indicated in FIG. 2(B), thereby venting part of the hydraulic oil from the first pump 1 to the tank 3 from the main passage 10, thus maintaining a controlled supply to the power steering system 5. At this time, the first switching valve 12 remains inoperative, whereby the hydraulic oil from the second pump 2 is returned to the tank 3 through the passage 11 and the drain path 15. Obviously, part of such hydraulic oil returns to the tank 3 through the drain passage 28 which communicates with the passage 11 through the second switching valve 20. The flow response under such condition is indicated by a solid line c in FIG. 3 which continues with the solid line a or b at a breakpoint X or Y while the dissipation of the horsepower is maintained sufficiently low as indicated by broken lines a in FIG. 4.

During such high speed rotation if the power steering system 5 is operated to assume a high pressure condition, both the first and the second switching valve 12 and 20 are operative as indicated in FIG. 2(C), with consequence that the passage 11 into which the hydraulic oil from the second pump 2 is introduced is connected through the bypass passage 30 and the second switching valve 20 to the drain passage 28 for communication with the tank 3. This hydraulic oil is returned to the tank 3 without opening the check valve 16. On the other hand, part of the hydraulic oil supplied from the first pump 1 to the main passage 10 is also returned to the tank 3 through the second switching valve 20, thus providing a constant supply of hydraulic oil to the power steering system 5. The resulting flow response is indicated by the solid line c in FIG. 3 while the dissipation of the horsepower is indicated by a solid line e which continues with the solid line c in FIG. 4 and which has a magnitude approximately one half the prior art value illustrated by phantom lines d in FIG. 4.

It is to be noted that in FIGS. 2(A) to (C), $P_1$ represents the pump 1, $P_2$ the second pump 2, T the tank 3 and P.S. the power steering system 5, respectively.

Figure 5:
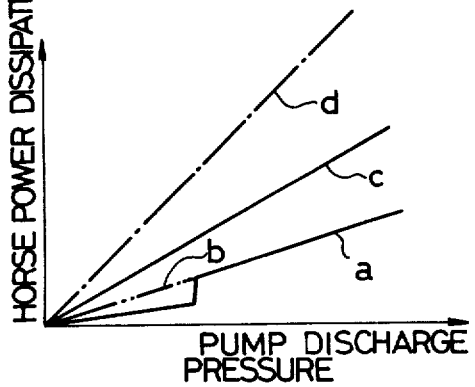

The energy saving effect achieved with the arrangement of the present embodiment will be apparent from FIG. 5 which illustrates the dissipation of the horsepower as a function of the discharge pressure of the pump.

When the number of revolutions of the pumps is low, the dissipation of the horsepower indicated by the solid line a will be approximately one-half the value of the prior art indicated by the phantom lines b, but will increase to the same value as the load increases.

As indicated by the solid line c, the dissipation of the horsepower in a range of high speed rotation may be approximately one-half the prior art value indicated by phantom lines d. This is because only the first pump 1 is concerned with the supply of the hydraulic oil to the power steering system 5 and the second pump 2 has nothing to do therewith, independently from the magnitude of the load during the high speed operation.

Figure 6:
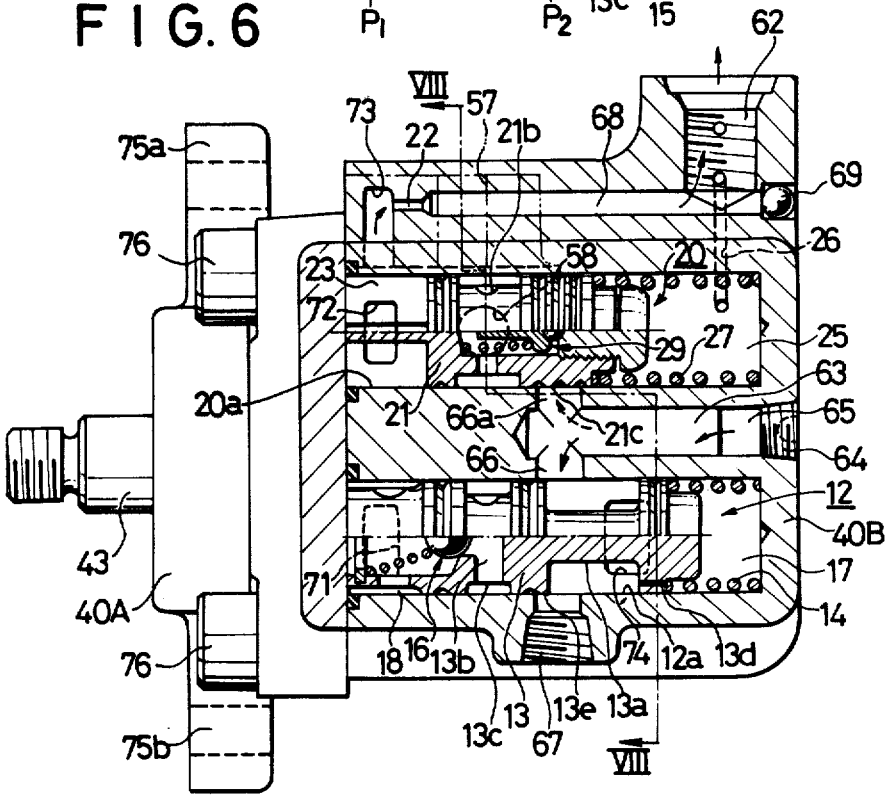
FIG. 6 is a cross section of an oil pump unit according to a specific embodiment of the invention.

It is another feature of the invention that the oil pump unit including the first and the second pump 1, 2 as well as the control 4 which is responsive to both the pressure and the number of revolutions for controlling the supply of the hydraulic oil discharged therefrom and which is integrally assembled with the unit, may be simply manufactured and assembled to reduce the manufacturing cost while satisfying the requirements for a reduced size and weight. This aspect will now be specifically described below with reference to FIG. 6 and subsequent Figures where it is to be noted that corresponding parts to those shown in FIG. 1 are designated by like reference characters.

Figure 7:
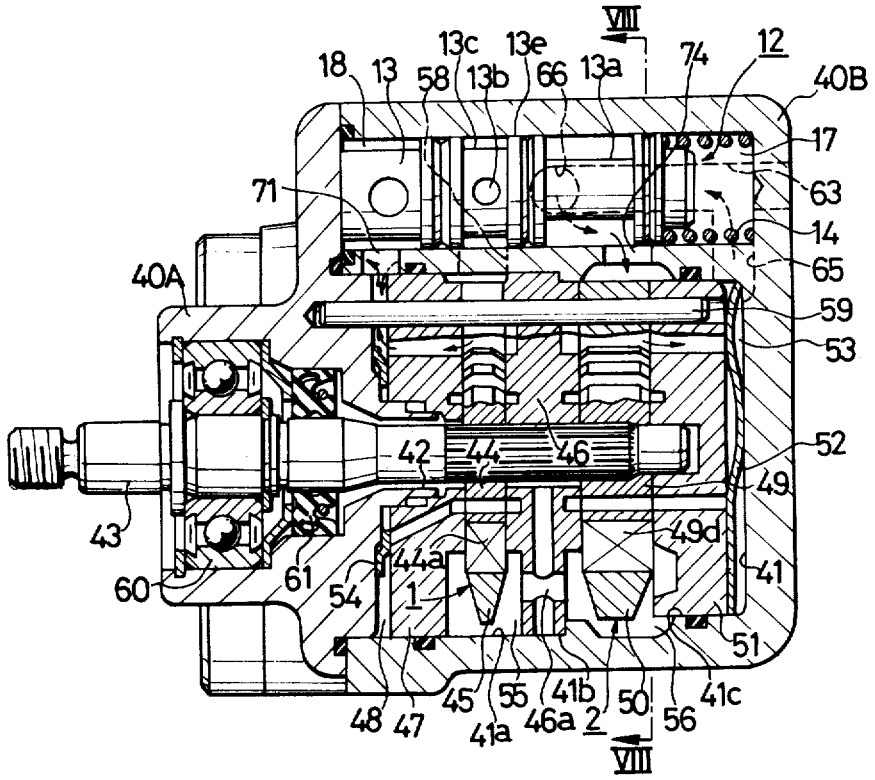
FIG. 7 is a longitudinal section of the pump unit shown in FIG. 6.
Figure 8:
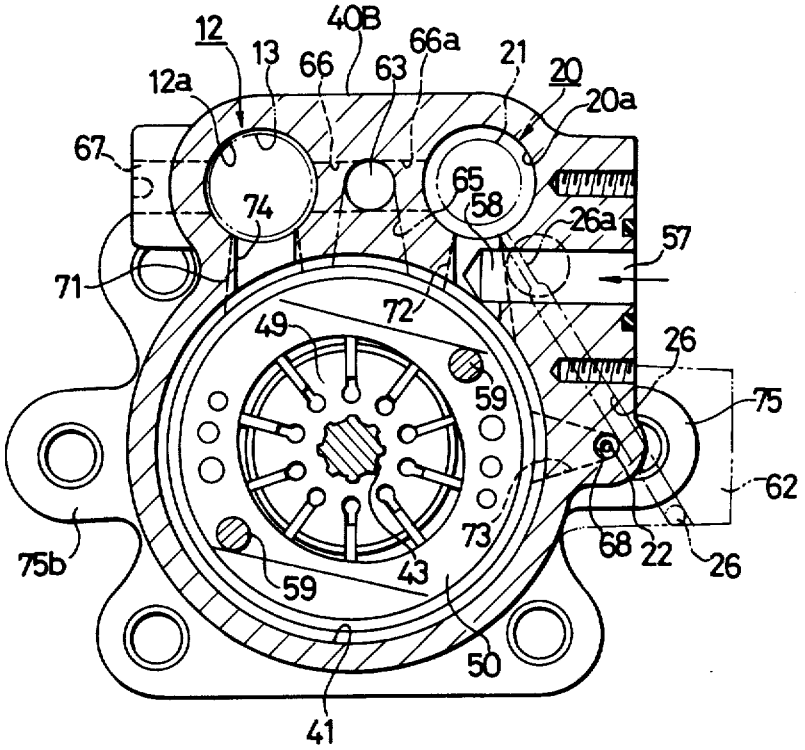
FIG. 8 is a cross section taken along the line VIII—VIII shown in FIGS. 6 and 7.
Figure 9:
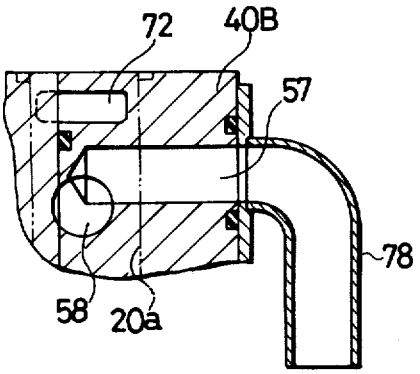
FIG. 9 is a detail view of a portion of the pump unit adjacent to an inlet passage.

Specifically, the pump unit includes a pair of a front and a rear pump body 40A, 40B. Integrally assembled into these bodies are a pair of first and second pumps 1, 2 having different discharge capacities as well as a pair of spool valves which form a first and a second switching vvalve 12, 20 for controlling the supply of hydraulic oil discharged from these pumps. Fluid passages which provide a suitable connection between these members are also formed therein. Thus, as indicated in FIGS. 7 and 8, the rear body 40B is centrally formed with a pump receiving space 41 which is closed at one end and which opens toward the front body 40A. The first and the second pump 1, 2 are disposed within the space 41 in axial alignment. These pumps 1, 2 are driven for rotation by a common drive shaft 43 which extends through a central bore 42 formed in the front body 40A, thus allowing their pumping operation.

In the embodiment shown, these pumps 1, 2 are of a vane type which is known in the prior art. Briefly describing the pump construction, the first pump 1 includes a rotor 44 fixedly mounted on the drive shaft 43 and carrying a plurality of vanes 44*a*, a cam ring 45, a sideplate 46 and a pressure plate 47. The first pump 1 is disposed in a portion 41*a* of the space 41 having an increased diameter and which is located adjacent to the opening end thereof. The sideplate 46 bears against a step 41*b* which is formed in the space 41 at an axially central portion thereof, and also serves as a sideplate for the second pump 2. The pressure plate 47 is located toward the opening end of the space 41, and cooperates with the front body 40A, which closes the open end, to define a pressure chamber 48 representing the discharge side of the pump.

Similarly, the second pump 2 comprises a rotor 49 fixedly mounted on the drive shaft 43 and carrying a plurality of vanes 49*a*, a cam ring 50 and a pressure plate 51. The second pump 2 is disposed in a portion 41*c* of the space 41 having a reduced diameter and which is located toward the bottom of the space 41.

A spring 52 is disposed between the pressure plate 51 and the bottom of the space 41, and such region represents a pressure chamber 53 representing the discharge side of the second pump 2. A spring 54 is also disposed in the pressure chamber 48 of the first pump 1, but it should be understood that the provision of these springs 52, 54 is not essential. Pressure chambers 55, 56 representing the suction side of the pumps are formed around the cam rings 45, 50 of the both pumps 1, 2, and communicate with each other through an opening 46*a* which is formed to extend through the sideplate 46. As shown in FIGS. 6 to 9, an operating oil from an oil tank, not shown, is introduced into the pressure chambers 55, 56 through an inlet passage 57 formed alongside the rear body 40B and a passage 58 communicating with a valve opening associated with one of the spool valves, as will be further described later. In these Figures, numeral 59 represents a rod which is utilized to position the various components of the pump, 60 a bearing for supporting the drive shaft 43 within the front body 40A, and 61 an oil seal which prevents a leakage of the oil to the exterior.

It is desirable that the various components of the both pumps 1, 2 may be disposed so as to be displaced from each other between the both pumps as viewed in the circumferential direction so that pulsations which occur in the discharge pressure from the respective pumps are phase displaced from each other to assure a smooth pumping action.

Suitably disposed around the space 41 and on the rear body 40B is a control including a first and a second switching valve 12, 20 and associated fluid passages, these valves being formed as a pair of spool valves for selectively supplying the hydraulic oil discharged from the first and the second pump 1, 2 to a hydraulic apparatus such as power steering system through an outlet passage 62 laterally opening through the rear end of the rear body 40B.

Specifically, a pair of valve openings 12*a*, 20*a* are formed in the upper portion of the rear body 40B in juxtaposed relationship and close to each other so as to extend axially parallel to the length of the space 41, and have open ends in the end of the rear body 40B which adjoins with the front body 40A, in the similar manner as the pump receiving space 41. It is to be understood that these valve openings 12*a*, 20*a* are closed in a liquid tight manner by the front body 40A together with the space 41.

Figure 10:
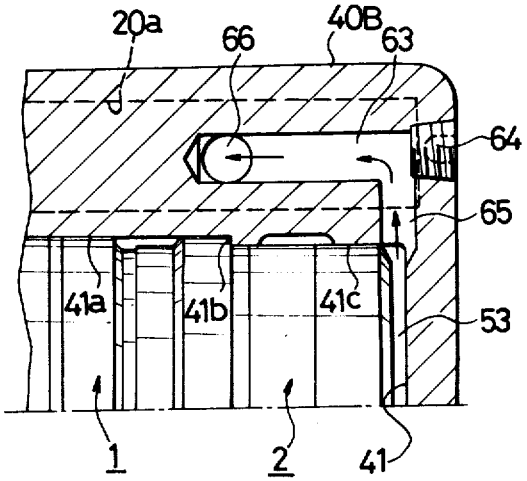
FIG. 10 is a detail view of a passage opening defined between a pair of valve openings.

An opening 63 is formed in the rear body 40B so as to be located intermediate the both valve openings 12*a*, 20*a*, and opens into the rear end of the rear body. The opening 63 has an axis which is situated in substantially the same plane as the axes of the valve openings 12*a*, 20*a*. As will be noted from FIG. 10, the open end of the opening 63 is closed by a blind plug 64, and communicates with a pressure chamber 53, representing the discharge side of the second pump 2, through a passage 65 which opens into the opening 63 from below toward the open end thereof. The other end of the opening 63 extends substantially to the axial central region of the rear body 40B where it is connected to a passage 66 extending from one lateral side of the rear body 40B to extend through one of the valve openings, 12*a*, to the other valve opening 20*a*.

With the described arrangement, the hydraulic oil discharged from the second pump 2 is introduced into the central region of the valve opening 12*a* through a passage (such as shown at 11 in FIG. 1) including the passage 65, the opening 63 and the passage 66. In this manner, the hydraulic oil from the second pump 2 can be introduced into the central region of the second valve opening 20*a* through an extension 66*a* of the passage 66. Such portion functions in the same manner as the bypass passage 30 shown in FIG. 1. It will be noted that the open end of the passage 66 is closed by a blind plug 67.

A common passage 68 is formed in the lateral portion of the rear body 40B so as to extend parallel to the space 41 and has an open end which opens into the rear end of the rear body. The passage 68 opens into the outlet passage 62. A ball 69 closes the open end of the common passage 68. A communication among the space 41, the pair of valve openings 12*a*, 20*a* and the common passage 68 is provided by rectangular flutes 71, 72, 73 formed in the rear body 40B so as to correspond to a pressure chamber 48, representing the discharge side of the first pump 1, which is defined adjacent to the open end of the pump receiving space 41.

A return path flute 74 is defined to communicate with the portion of the first valve opening 12*a* at a location rearwardly of the passage 66 through which the hydraulic oil from the second pump 2 is introduced, and also communicate with the pump receiving space 41 at a point which corresponds to a pressure chamber 56, representing the suction side of the second pump 2. An inlet passage 57 extends into the rear body 40B from one lateral side thereof and communicates with a passage 58 which opens into the second valve opening 20*a* at a point forwardly of the axial center thereof. As shown in FIG. 7, the passage 58 is connected to the space 41 at a point corresponding to a pressure chamber 55, representing the suction side of the first pump 1. A small opening is defined between the common passage 68 and the flute 73 for detecting the flow supplied to the hydraulic apparatus in terms of a pressure differential thereacross, thus operating as an orifice 22 which allows the second switching valve 20 to function as a flow control valve as will be further described later.

A first and a second switching valve 12, 20, defined by spool valves 13, 21, respectively, are assembled into the valve openings 12*a*, 20a, respectively, to operate as a pressure sensor and a flow controller. Specifically, the spool valve 13 assembled into the valve opening 12*a* is normally urged against the front body 40A by means of a spring 14 which is disposed toward the bottom of the valve opening. Under this condition, an annular groove 13*a* formed therearound toward the rear end thereof provides a communication between the passage 66 and the return path flute 74, whereby the hydraulic oil from the second pump 2 is returned to the suction side of the pump. A check valve 16 is disposed toward the front end of the spool valve 13 and is connected to the opening 63 and the passage 66 extending to the second pump 2, through an opening 13*b* and its surrounding annular groove 13*c* whenever the spool valve 13 has moved toward its rear side. Obviously, during such operation, a communication between the passage 66 and the return path flute 74 is interrupted by a land 13*e* of the spool valve. The check valve 16 is opened by the hydraulic oil from the second pump 2, allowing the latter to be introduced into the pressure chamber 48, representing the discharge side of the first pump 1, through the flute 71 which opens into the front portion of the valve opening 12*a*, so as to be merged with the hydraulic oil discharged from the first pump 1.

In the first switching valve 12 thus constructed, a high pressure chamber 18 is defined by the front end of the spool valve 13, and the hydraulic oil from the pressure chamber 48, representing the discharge side of the first pump 1, is introduced into the chamber 18 through the flute 71. A low pressure chamber 17 is defined by the rear end of the spool valve, and the hydraulic oil for the suction side is introduced into the chamber 17 through the small opening 13*d*. The spool valve 13 functions as a pressure sensing flow path switching valve which effects a switching of the flow path only in response to a rise, caused by an increased load on the hydraulic apparatus, in the hydraulic pressure prevalent in the main supply passage which is formed by the pressure chamber 48, the flute 71 and the common passage 68 including the orifice 22.

The spool valve 21 which is assembled into the valve opening 20*a* operates as a flow control valve of known form. Specifically, a high pressure chamber 23 is defined in the front portion of the valve opening 20*a* by the spool valve 21, and the hydraulic oil from the pressure chamber 48 or upstream of the flow detecting orifice 22 is introduced into the chamber 23 through the flute 72. A low pressure chamber 25 is defined in the rear portion of the valve opening 20*a*, and the hydraulic oil downstream of the orifice 22 is introduced into the chamber 25 through a path 26 which communicates with the outlet passage 62. The spool valve 21 is normally urged by a spring 27, disposed within the low pressure chamber 25, to assume a forward position within the valve opening 20*a* where an annular groove 21*b* formed around the spool valve in the central region thereof is located opposite to the passage 58 leading to the inlet passage 57 while isolating the passage 58 from the pressure chamber 48 representing the discharge side. When the flow of the hydraulic oil which is delivered from the pressure chamber 48 increases to exceed a given value, a pressure differential developed across the orifice 22 causes the spool valve 21 to move within the valve opening 20*a*, achieving a communication between the passage 58 and the pressure chamber 48 so as to permit a flow of the hydraulic oil which exceeds the given value to be returned to the suction side of the pump.

It is to be noted in the second switching valve 20 that the extension 66*a* of the passage 66 which introduces the hydraulic oil from the second pump 2 opens into the valve opening 20*a* thereof, thereby allowing it to operate as a flow path switching valve in addition to its normal operation as a flow control valve. Specifically, as the second switching valve 20 is operated, the extension 66*a* of the passage 66 which is normally blocked by a land 21*c* of the spool valve 21 is connected through an annular groove 21*b* to the passage 58 extending to the tank. Under this condition, if the first switching valve 12 is operated in response to an increased load on the hydraulic apparatus to permit a communication to be established between the passages 63, 66 and the check valve 16, the check valve 16 cannot be opened, allowing the hydraulic oil from the second pump 2 to be returned to the tank without being merged with the hydraulic oil from the first pump 1. In other words, the second pump 2 is maintained under no-load condition, reducing its dissipation of the horsepower.

Figure 11:
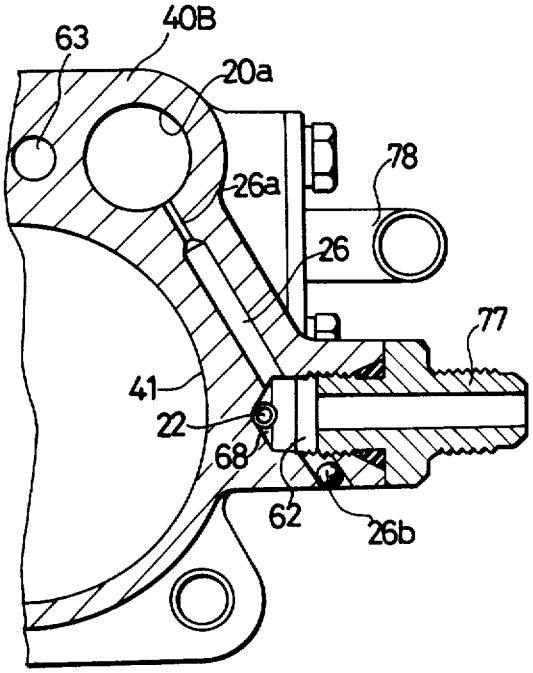
FIG. 11 is a detail view of the junction between an outlet passage and a second valve opening.

The path 26 which provides a communication between the outlet passage 62 and the low pressure chamber 25 is defined by an opening which is formed to extend into the body providing the outlet passage 62, as indicated in FIGS. 8 and 11, thus facilitating its machining. An orifice 26*a* is provided to prevent the oscillation of the spool valve 21, and a ball 26*b* closes the open end of the path 26. In addition, it will be noted that a relief valve 29 of a known form is provided within the spool valve 21.

Figure 12:
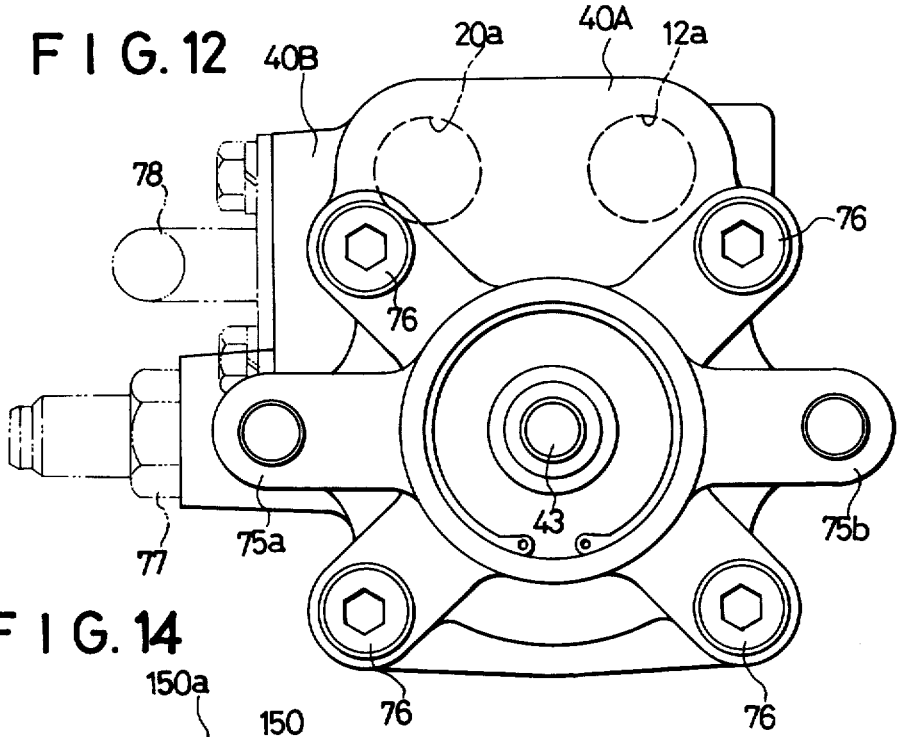
FIG. 12 is a side elevation of the overall unit.

Referring to FIG. 12, it will be seen that a pair of mounting brackets 75*a*, 75*b* laterally projects from the both sides of the front body 40A, and that the front body 40A and the rear body 40B are integrally fastened together by four bolts 76. An outlet member 77 for connection with the hydraulic apparatus and an inlet member 78 for connection with the oil tank are externally mounted on the rear body 40B in alignment with the outlet passage 62 and the inlet passage 57, respectively.

In the described oil pump unit, the pair of switching valves 12, 20 which operate as a pressure sensor and a flow controller have their valve openings 12*a*, 20*a* arranged around the pump receiving space 41 which is centrally formed within the pump body so that their axes are parallel to each other and so that they are located close to each other. In addition, various passages and paths which connect these valve openings 12*a*, 20*a* with the space 41 as well as other passages which extend to the fluid inlet and outlet are formed by an integral casting with the pump body or can be formed by a simple boring operation. As an overall effect, the pump unit is entirely compact and simple in construction, facilitating its manufacture and assembly, thus contributing to a reduction in the manufacturing cost.

In addition, as described in connection with the embodiment, the pump receiving space 41 as well as the pair of valve openings 12*a*, 20*a* open into the end of the rear body 40B which adjoins with the front body 40A, allowing the various components of the pump including the spools and the springs to be assembled into the pump body through these open ends, thus greatly facilitating the assembly. In addition, the described construction is advantageous in respect of achieving a good sealing effect of the various open ends.

The high pressure chambers 18, 23 are formed in the open ends of these valve openings 12*a*, 20*a*, and are associated with flutes 71, 72 to provide a communication with the pressure chamber 48, formed in the space 41 and representing the discharge side of the first pump 1. The pressure chamber 48 communicates with the common passage 68 of the output side through the flute 73, allowing the pressure chamber 48 to be utilized as the main supply passage including a junction for merging the hydraulic oil from the second pump 2 with the hydraulic oil from the first pump 1. In this manner, the pump construction is further simplified.

Figure 14:
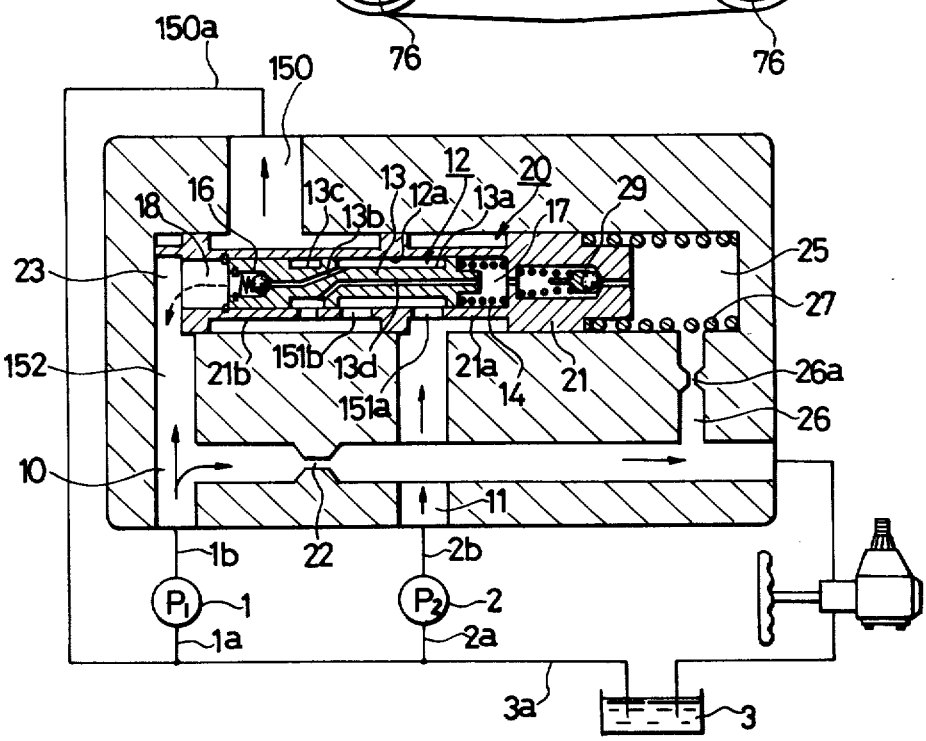
FIGS. 13 to 15 are schematic views illustrating other embodiments of the invention.
Figure 13:
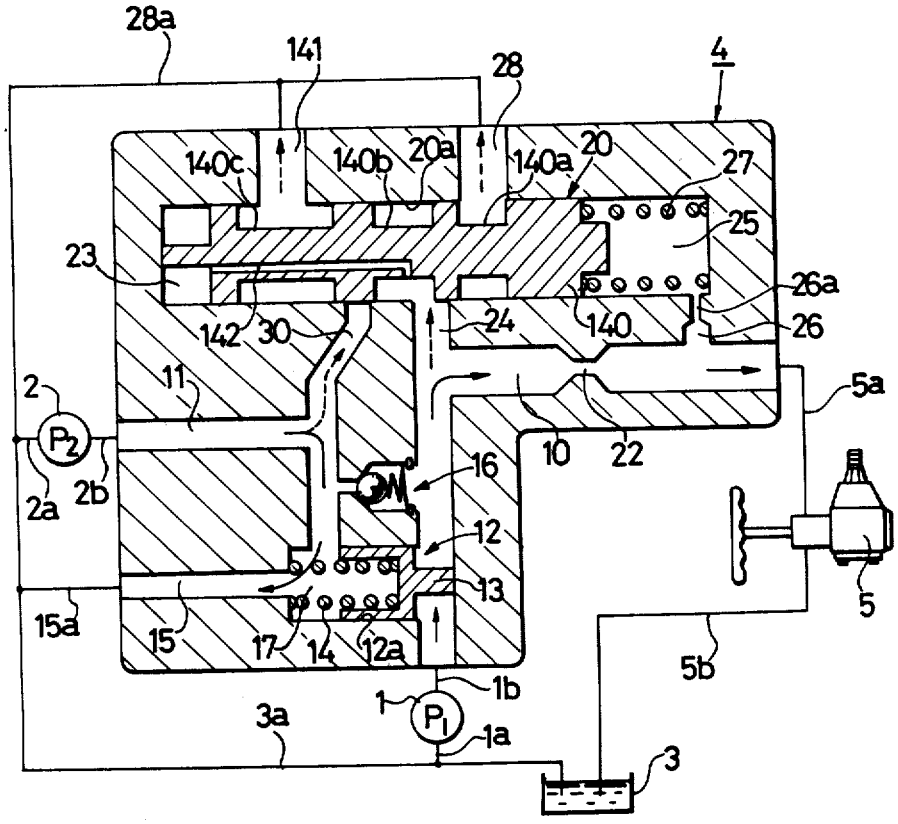
Figure 15:
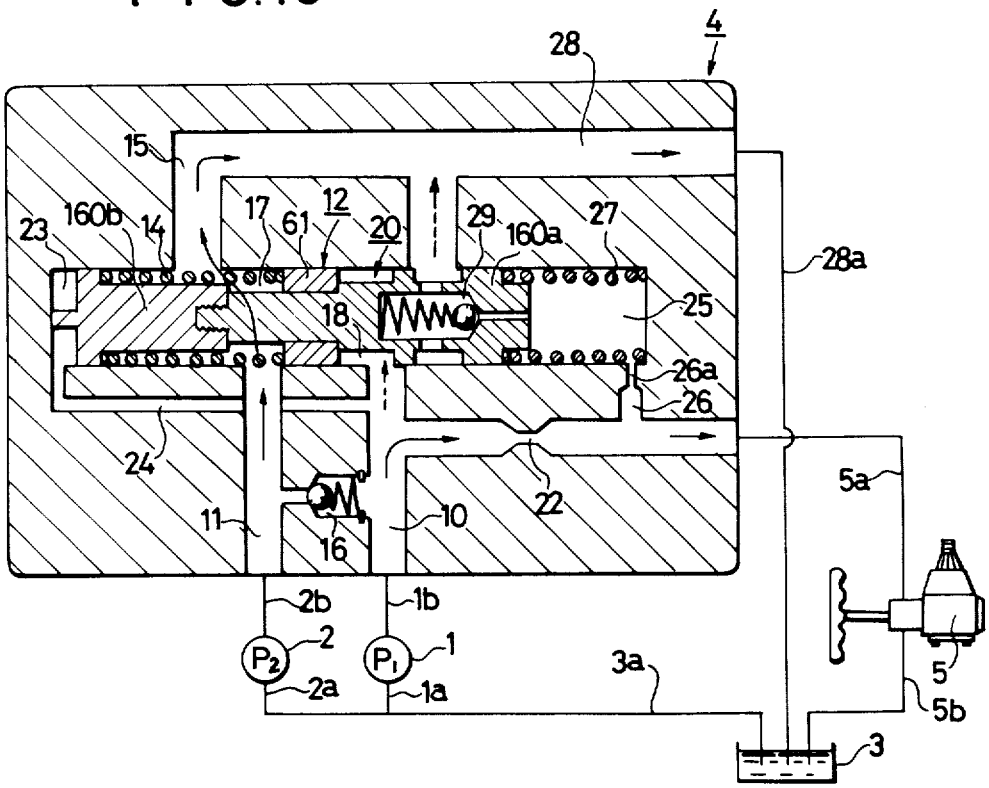

FIGS. 13 to 15 illustrate hydraulic fluid supply apparatus according other embodiments of the invention. In these Figures, corresponding parts to those shown in FIG. 1 are designated by like reference numerals or characters, and their description will be omitted.

In an embodiment shown in FIG. 13, the arrangement of the first switching valve 12 is simplified. It includes a spool valve 13 which merely operates to allow or interrupt a communication between a passage 11 and a drain path 15. A one way valve 16 is separately provided between the passage 11 and a main passage 10. A second switching valve 20 includes a spool valve 140 which is circumferentially formed with three axially displaced annular grooves 140*a*, 140*b*, 140*c*. A drain passage 141 for returning the hydraulic oil from the passage 11 to the tank is provided separately from a drain passage 28 associated with the main passage 10. The annular grooves 140*a*, 140*b* operate to provide or interrupt a communication between the main passage 10 and the drain passage 28 while the remaining annular groove 140*c* operates to provide a communication between the passage 11 and the drain passage 141. A path 142 is formed to extend axially through the spool valve 140 to connect the main passage 10 with a high pressure chamber 23.

In an embodiment shown in FIG. 14, a first switching valve 12 is assembled into a second switching valve 20, and a drain passage 150 and a drain line 150*a* are used in common to return the hydraulic oil from a first and a second pump 1, 2 to a tank 3. A pair of bypass openings 151*a*, 151*b* are provided to connect the first and the second switching valve 12, 20 together while a common passage 152 connects a passage 11 to a main passage 10 through a one way valve 16. The common passage 152 serves connecting the main passage 10 with a high pressure chamber 23 of the second switching valve 20.

In an embodiment shown in FIG. 15, a second switching valve 20 includesi a pair of split spool valves 160*a*, 160*b*, and an annular spool 161 which forms a first switching valve 12 is slidably fitted into a portion of the spool valve 160*a* which has a reduced diameter. A one way valve 16 is separately provided between a main passage 10 and a passage 11. When operated, the annular spool 161 moves to the right as the spool valves 160*a*, 160*b* move to the right, as viewed in this Figure, thereby switching a flow path. In this instance, a bypass passage between the both valves 12, 20 is dispensed with.

It will be readily apparent that while the embodiments shown in FIGS. 13 to 15 are modified from the first embodiment in described respects, they achieve substantially the similar effect as the first embodiment.

In the embodiments described above, only the first and the second pump 1, 2 are used to supply the hydraulic pressure to the hydraulic apparatus 5. However, it should be understood that the invention is not limited to such an arrangement, but that a plurality of pumps may be used, with one being used as a main pump while the remaining pumps being used as sub-pumps to be successively connected to or disconnected from the passage associated with the main pump.

While the invention has been shown and described in connection with several embodiments thereof, it should be understood that certain changes, modifications and variations can be made therein departing from the scope and spirit of the invention as defined by the appended claims.

What is claimed is:

1. An oil pump unit comprising a first and a second pump for separately discharging a hydraulic fluid, a main passage for supplying the hydraulic fluid from the first pump to a hydraulic apparatus, a first switching valve normally connecting the second pump with a tank, the first switching valve being responsive to an increased load on the hydraulic apparatus to disconnect the second pump from the tank to connect the second pump with the main passage through a one way valve, and a second switching valve operative whenever a flow of the hydraulic fluid from the main passage exceeds a given value to vent part of the hydraulic fluid to the tank from the main passage and operative to connect the second pump with the tank if the first switching valve is operated under this condition.

2. An oil pump unit according to claim 1 in which the first and the second switching valve communicate with each other.

3. An oil pump unit according to claim 2 in which the one way valve is internally housed within the valve body of the first switching valve.

4. An oil pump unit according to claim 2 in which the one way valve is separate from the valve body of the first switching valve.

5. An oil pump unit according to claim 1 in which the first switching valve is internally housed within the second switching valve.

6. An oil pump unit according to claim 1 in which the first and the second switching valve are received within a common valve opening and are fitted together so as to be slidable relative to each other.

7. An oil pump unit according to one of claims 1 to 6 in which the first switching valve is operated whenever the pressure within the main passage exceeds a given value.

8. An oil pump unit according to one of claims 1 to 6 in which the second switching valve operates in response to a pressure differential across an orifice which is formed in the main passage.

9. An oil pump unit including a pump body in which are integrally assembled a pair of pumps for separately discharging a hydraulic fluid as well as a pair of spool valves for switching a flow path of the hydraulic fluid from the both pumps to control the supply to a hydraulic apparatus; characterized in that the pump body comprises a pump receiving space in which the pair of pumps are disposed in juxtaposed relationship on a common drive shaft, a pair of valve openings for the pair of spool valves formed around the pump receiving space and close to each other so that their axes extend parallel to the axis of the space, flutes extending between the both valve openings and the pump receiving space to introduce the hydraulic fluid from one of the pumps to one end of the both valve openings, and a passage opening located between the both valve openings and into which the hydraulic fluid from the other pump is introduced, the passage opening being connected to the both valve openings at substantially an axially central region thereof through a path which is normally directed by a spool to be connected with the suction side of the pump within said one valve opening and connected to a chamber therein into which the flute opens, through a check valve whenever the spool is operated and which is normally blocked by a spool in the other valve opening and connected to the suction side of the pump whenever the spool is operated.

10. A hydraulic system, comprising: a power steering device; a steering wheel for operating said power steering device; a reservoir for hydraulic fluid; first and second pumps each having an inlet and an outlet, said pumps being adapted for individually delivering separate flows of pressurized hydraulic fluid through their respective outlets; means defining a main passage connected between the outlet of said first pump and said power steering device for supplying pressurized hydraulic fluid for operating said power steering device; a pressure-sensitive, first switching valve comprising an elongated first chamber having at one longitudinal end thereof a first port which is connected to said main passage, said first chamber having in the side wall thereof a first inlet opening which is connected to the outlet of said second pump, a first outlet opening which is connected to said reservoir and a second outlet opening, a first spool valve slidably disposed in said first chamber so that one end thereof is acted on by the hydraulic pressure in said first port and first spring means acting on the other end of said first spool valve for continuously urging said first spool valve toward said first port whereby said first spool valve is normally positioned in a first position when the hydraulic pressure in said first port is low and is shiftable to a second position when the hydraulic pressure in said first port is sufficient to overcome the biasing force of said first spring means, said first spool valve having a first passage for connecting said first inlet opening to said first and second outlet openings when said first spool valve is in said first position and for isolating said first inlet opening from said first outlet opening when said first spool valve is in said second position, said first spool valve having a second passage for connecting said first inlet opening to said first port and a third passage for connecting said first inlet opening to said second outlet opening when said spool valve is in said second position, said second passage having a first one-way valve therein so that hydraulic fluid can flow only from said first inlet opening to said first port and not vice versa, a flow control, second, switching valve comprising an elongated second chamber having at one longitudinal end thereof a second port which is connected to said main passage at a location therein downstream from said first port, said second chamber having in the side wall thereof a second inlet opening connected to said second outlet opening of said first switching valve and a third outlet opening connected to said reservoir, said main passage having an orifice therein located downstream from said second port, said second chamber having at the other longitudinal end thereof a third port which communicates with said main passage downstream from said orifice, a second spool valve slidably disposed in said second chamber so that one end thereof is acted on by the hydraulic pressure in said second port, second spring means acting on the other end of said second spool valve in combination with the hydraulic pressure supplied through said third port for continuously urging said second spool valve toward said second port whereby said second spool valve is normally positioned in a first position when the hydraulic pressure in said second port is low and is shiftable to a second position when the hydraulic pressure in said second port is sufficient to overcome the biasing force of said second spring means and the hydraulic pressure in said third port, said second spool valve having a first valve element for blocking communication between said second port and said third outlet opening when said second spool valve is in its first position and for establishing communication therebetween when said second spool valve is in its second position, said second spool valve having a second valve element for blocking communication between said second inlet opening and said third outlet opening when said second spool valve is in its first position and for establishing communication therebetween when said second spool valve is in its second position, said second spool valve having a fourth passage connecting said third port to said third outlet opening, said fourth passage having a second one-way valve therein so that hydraulic fluid can flow from said third port to said third outlet opening and not vice versa.

* * * * *